United States Patent [19]

Peters

[11] Patent Number: 4,498,670

[45] Date of Patent: Feb. 12, 1985

[54] WIDE FACE HORIZONTALLY MOVABLE KICKER FOR PIN BALL GAME

[75] Inventor: Albin Peters, Chicago, Ill.

[73] Assignee: Wico Corporation, Niles, Ill.

[21] Appl. No.: 409,411

[22] Filed: Aug. 19, 1982

[51] Int. Cl.[3] ..... A63F 7/00

[52] U.S. Cl. ..... 273/129 V

[58] Field of Search ..... 273/129 R, 129 V, 123 R, 273/123 A, 125 R, 120 R, 120 A, 121 A, 121 D, 122 A, 124 A, 125 A, 85 F, 129 S; 200/61.11

[56] References Cited

U.S. PATENT DOCUMENTS

| | | | |
|---|---|---|---|
| 2,035,271 | 3/1936 | MacDougall | 273/129 V |
| 3,391,937 | 7/1968 | Seiden | 273/129 V |
| 4,119,314 | 10/1978 | Moena | 273/85 F |
| 4,203,602 | 5/1980 | Kral | 273/121 A |
| 4,300,769 | 11/1981 | Momura et al. | 273/129 V |

*Primary Examiner*—Richard C. Pinkham
*Assistant Examiner*—T. Brown
*Attorney, Agent, or Firm*—Emrich & Dithmar

[57] ABSTRACT

A kicker apparatus for a pin ball game including a playfield board on which a ball rolls for engagement with an actuator member in a kicking region, comprises a frame which mounts a kicker member in a track for sliding reciprocating movement in response to actuation of a drive means by engagement of the ball with the actuator member, for driving a kicking surface on the kicker member into engagement with the ball to propel it from the kicking region. The kicking surface is a substantially flat, planar surface elongated in a direction transverse to the kicker member path.

7 Claims, 7 Drawing Figures

WIDE FACE HORIZONTALLY MOVABLE KICKER FOR PIN BALL GAME

BACKGROUND OF THE INVENTION

The present invention relates to kicker apparatus for a ball rolling game, such as an electromechanical pin ball game. Kicker assemblies are used, for example, in bumper assemblies of a pin ball game, such as a slingshot-type bumper assembly. Such a bumper assembly is disclosed, for example, in copending application Ser. No. 338,314, filed Jan. 11, 1982 (abandoned). This type of bumper assembly typically includes a resilient bumper member adapted for engagement by a rolling pin ball. In order to accelerate the ball as it rebounds from the resilient bumper member, there is also provided a kicker apparatus which is actuated in response to impact of the ball on the resilient bumper for triggering a kicker into engagement with the inner side of the bumper to impart a propelling force to the pin ball which is substantially greater than the force which could have been imparted by the resilient bumper member itself.

The kicker member typically has a very narrow kicking surface which engages the bumper member at a predetermined point thereon. Thus, the maximum kicking impact and maximum bumper member deflection will occur at that point, with the deflection decreasing proportionally with the distance from this impact point. The farther away from the kicker impact point that a ball impacts on the bumper member, the less will be the rebound force imparted thereto. Furthermore, the narrow-faced kicker member is not suitable for use in a kicker assembly wherein the kicker engages a pin ball directly.

SUMMARY OF THE INVENTION

It is a general object of the present invention to provide an improved kicker apparatus for a pin ball game, which avoids the disadvantages of prior apparatuses while affording additional structural and operating advantages.

An important object of the invention is the provision of a kicker apparatus which can impart a kicking force over a wide area.

It is another object of this invention to provide a kicker apparatus of the type set forth, which has a kicker member adaptable for direct engagement with an associated pin ball to impart a propelling force thereto.

These and other objects of the invention are attained by providing a pin ball game kicker apparatus comprising a frame, a kicker member carried by the frame and movable in a predetermined path between a normal rest position and a kicking position, said kicker member having a kicking surface with a length in a direction transverse to the path greater than the diameter of an associated pin ball, and drive means carried by the frame and coupled to the kicker member for effecting movement thereof between the rest and kicking positions thereof.

The invention consists of these and other novel features and a combination of parts hereinafter fully described, illustrated in the accompanying drawings, and particularly pointed out in the appended claims, it being understood that various changes in the details may be made without departing from the spirit, or sacrificing any of the advantages of the invention.

DESCRIPTION OF THE PREFERRED EMBODIMENT

Figure 1:
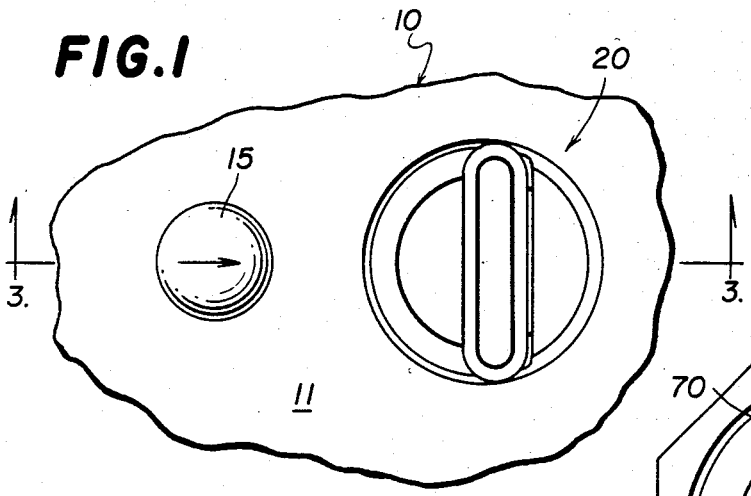
FIG. 1 is a fragmentary, top plan view of a portion of a pin ball game playfield board carrying a kicker apparatus constructed in accordance with and embodying the features of the present invention.
Figure 2:
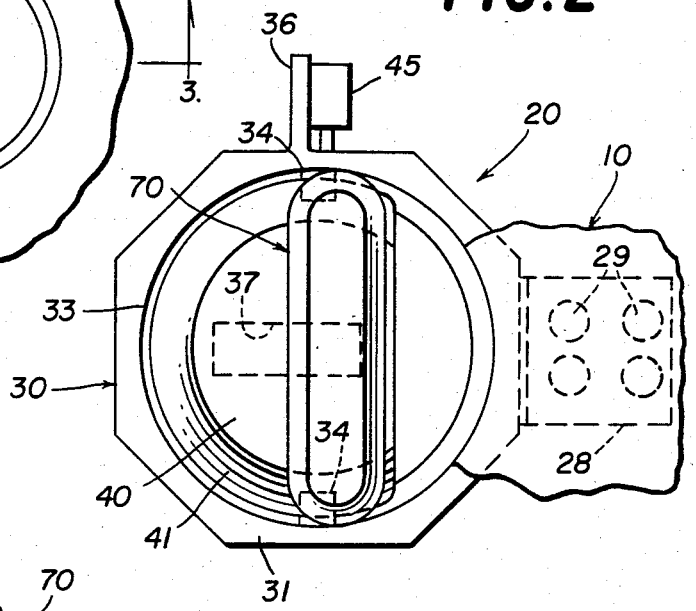
FIG. 2 is an enlarged, fragmentary, top plan view, similar to FIG. 1, with portions of the playfield board removed to show the kicker apparatus construction.
Figure 3:
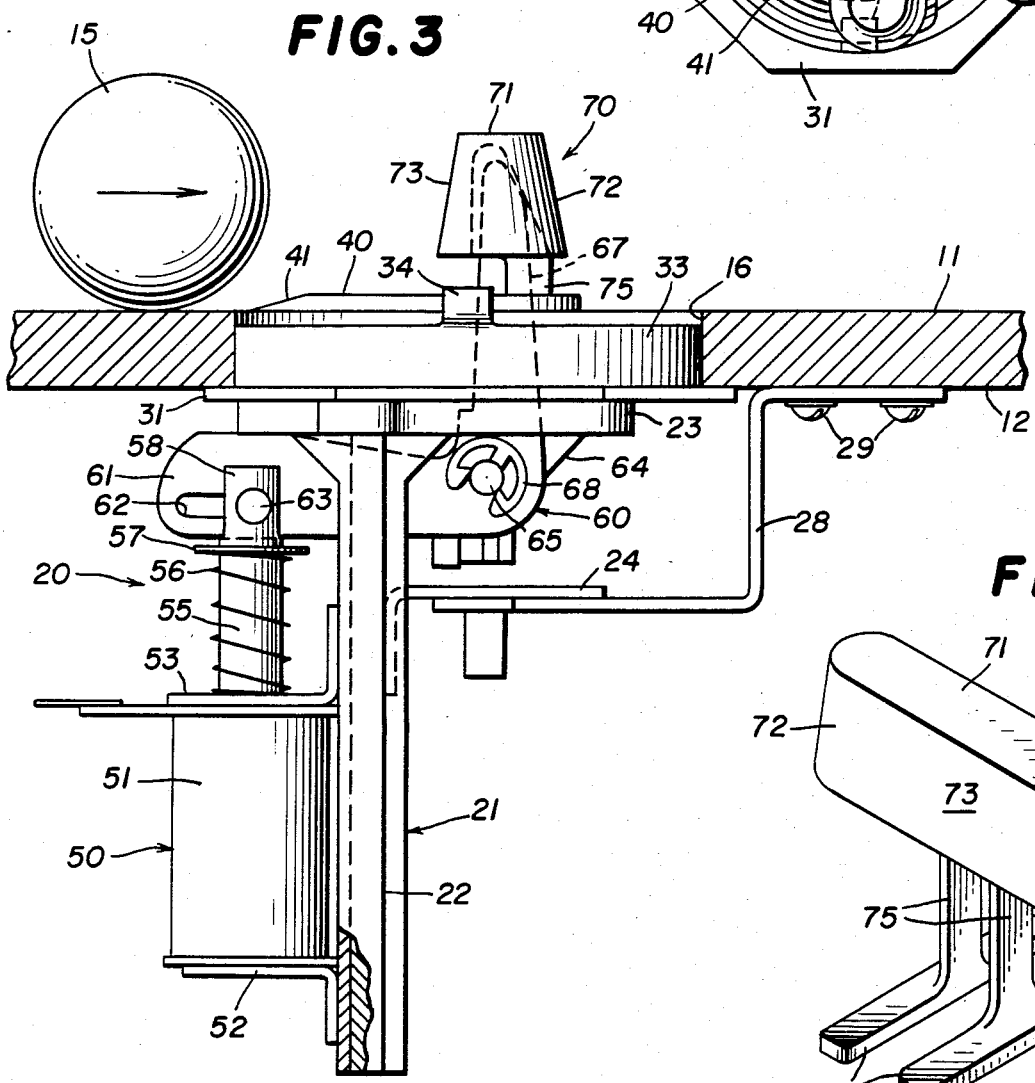
FIG. 3 is an enlarged, fragmentary view in vertical section taken along the line 3—3 in FIG. 1.
Figure 4:
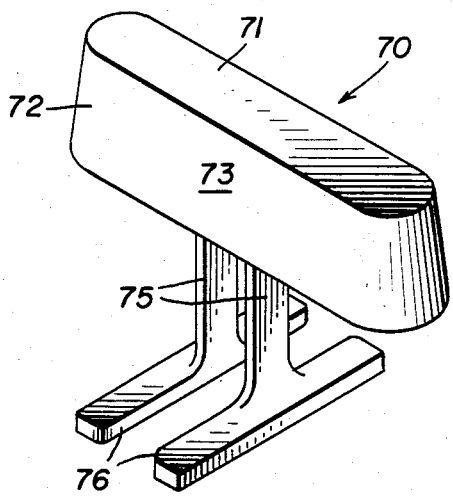
FIG. 4 is an enlarged, front perspective view of the kicker member of the kicker apparatus of FIG. 1.

Referring to FIGS. 1–3 of the drawings, there is illustrated a portion of a pin ball game playfield board, generally designated by the numeral 10, having flat, parallel upper and lower surfaces 11 and 12. In use, a pin ball 15 rolls along the upper surface 11 of the playfield board 10 for engagement with a number of targets in a well known manner. One such target is illustrated in the drawings and comprises a kicker assembly, generally designated by the numeral 20, which is mounted beneath the playfield board 10 and a portion of which extends upwardly through a circular aperture 16 in the playfield board 10.

Referring now also to FIGS. 4–7 of the drawings, the kicker assembly 20 includes a frame 21 having a generally rectangular main plate 22 which is disposed substantially perpendicular to the playfield board 10 and has fixedly secured thereto at the upper end thereof a flat, irregular attachment plate 23. Secured to the main plate 22 is an angle bracket 24, which is in turn connected to a Z-shaped mounting bracket 28, one leg of which is fixedly secured, as by fasteners 29, to the lower surface 12 of the playfield board 10. Formed in the upper surface of the attachment plate 23 are two parallel, spaced-apart, elongated track channels 25 (see FIGS. 5 and 7), each being generally rectangular in transverse cross section and extending the length of the attachment plate 23. When the frame 21 is secured to the playfield board 10, the track channels 25 cooperate to define a path extending substantially parallel to the playfield board 10.

The main plate 22 has formed therein at the upper end thereof a rectangular opening or notch 26 (FIG. 7) which communicates with a large rectangular opening 27 in the attachment plate 23. Overlying the attachment plate 23 is a top base, generally designated by the numeral 30, having a substantially octagonal flat bottom plate 31 fixedly secured, as by studs (not shown), to the attachment plate 23. Integral with the bottom plate 31 and projecting upwardly therefrom is a circular cylindrical wall 33 which is dimensioned snugly to be received in the circular aperture 16 in the playfield board 10, with the bottom plate 31 engaging the lower surface 12 of the playfield board 10, when the frame 21 is mounted in place. Integral with the cylindrical wall 33 at diametrically spaced-apart points therealong and projecting radially inwardly therefrom at the top edge thereof are two short, rectangular, upwardly inclined tabs 34. Integral with the bottom plate 31 and projecting upwardly therefrom respectively adjacent to the tabs 34 are two cylindrical bushings 35.

Figure 5:
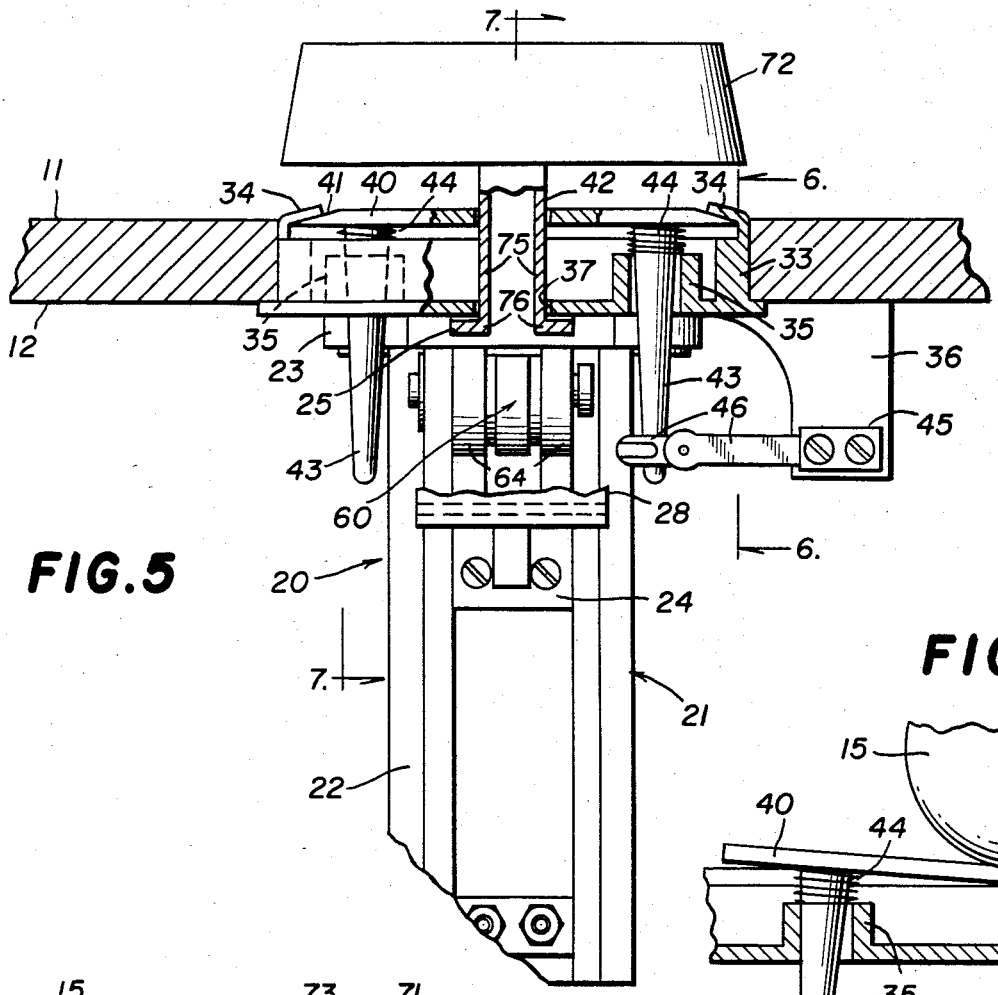
FIG. 5 is a fragmentary, rear elevational view of the kicker apparatus of FIG. 3, as viewed from the right-hand side thereof, in partial vertical section.
Figure 6:
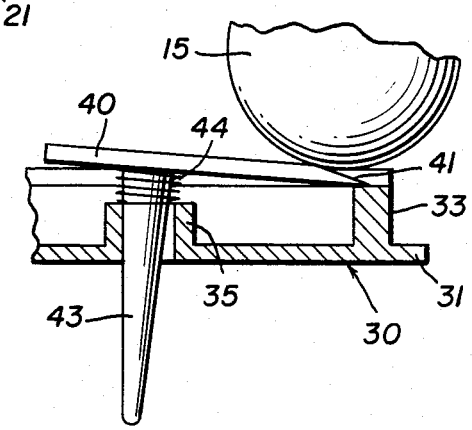
FIG. 6 is a fragmentary view in vertical section taken along the line 6—6 in FIG. 5.

The top base 30 is dimensioned so that, when mounted in place, the upper edge of the cylindrical wall 33 is disposed a slight distance below the upper surface 11 of the playfield board 10, and a slight distance above the tops of the bushings 35. Integral with the bottom plate 31 and projecting laterally outwardly therefrom is a depending, generally rectangular attachment arm 36 (FIG. 5). Formed in the bottom plate 31 substantially midway between the tabs 34 is a rectangular aperture 37 disposed in registry with the rectangular opening 27 in the attachment plate 23.

Overlying the top base 30 is a part-circular, disc-like tilt plate 40, provided along the arcuate portion thereof with a beveled edge 41. The tilt plate 40 has a diameter slightly less than the diameter of the aperture 16 in the playfield board 10, but greater than the inner diameter of the cylindrical wall 33 of the top base 30. The tilt plate 40 has formed therein a rectangular aperture 42 disposed in registry with the aperture 37 in the top base 30. Integral with the tilt plate 40 and depending therefrom are two elongated and downwardly tapered actuator posts 43, respectively disposed for reception through the bushings 35. Each of the actuator posts 43 is dimensioned so that at the upper end thereof it has a diameter slightly less than the inner diameter of the associated bushing 35, each post 43 having a length such that it extends downwardly well below the bottom plate 31. Respectively disposed in surrounding relationship with the actuator posts 43 above the bushings 35 are two helical compression springs 44, each dimensioned to seat upon the associated bushing 35 for resiliently biasing the tilt plate 40 upwardly. The beveled edge 41 of the tilt plate 40 is fitted beneath the tabs 34 on the top base 30, for retaining the tilt plate 40 in place in a substantially horizontal normal rest position, against the urging of the compression springs 44. Mounted on the attachment arm 36 is an electrical switch 45 having a pair of elongated contact arms 46, one of which is disposed for engagement by one of the actuator posts 43 (see FIG. 5).

The kicker assembly 20 also includes a drive solenoid, generally designated by the numeral 50, which includes a coil 51, the opposite ends of which are respectively secured to bottom and top brackets 52 and 53, which are in turn fixedly secured by suitable fasteners to the main plate 22 of the frame 21. The solenoid 50 has a plunger rod or armature 55, the solenoid 50 being oriented so that the plunger rod 55 projects upwardly therefrom with the axis thereof disposed substantially perpendicular to the playfield board 10. A compression spring 56 is disposed in surrounding relationship with the plunger rod 55 and is retained thereon between the top bracket 53 and an E-ring retainer 57.

The upper end of the plunger rod 55 is formed as a clevis 58 which receives therein one arm 61 of a drive crank 60. More particularly, the arm 61 has an elongated slot 62 therethrough in which is received a coupling pin 63 for pivotally coupling the arm 61 to the clevis 58. The drive crank 60 is disposed between spaced-apart mounting lugs 64 on the frame 21 and is adapted for pivotal movement about the axis of a pivot pin 65 which extends through the mounting lugs 64 and through a complementary opening in the drive crank 60. Preferably, the pivot pin 65 is disposed below the attachment plate 23 and with the axis thereof disposed substantially parallel to the playfield board 10 and perpendicular to the path defined by the track channels 25. The other arm 67 of the drive crank 60 projects upwardly through the opening 27 and the apertures 37, 42 and 16 and extends well above the playfield board 10. The pivot pin 65 is retained in place by E-rings 68 (see FIG. 3).

The kicker assembly 20 also includes a kicker member 70 which generally defines an open-bottom box or receptacle including a top wall 71 and a depending oblong cylindrical side wall 72. The front portion of the side wall 72 has a generally rectangular, flat, planar outer kicking surface 73, elongated in a direction transverse to the track channels 25. The plane of the kicking surface 73 may be inclined at a relatively large acute angle with respect to the playfield board 10 or may be substantially perpendicular thereto. Integral with the top wall 71 and the side wall 72 and depending therefrom are laterally spaced-apart parallel legs 75, each integral at the lower end thereof with an elongated rail foot 76 extending substantially perpendicular thereto. Also integral with the legs 75 and closing the space therebetween at the upper ends thereof are a substantially vertical forward bearing wall 77 and a downwardly and rearwardly inclined rear bearing wall 78 (see FIG. 7), the bearing walls 77 and 78 cooperating with the legs 75 and the top wall 71 to define a receptacle 79.

In use, the receptacle 79 of the kicker member 70 is fitted over the upper end of the drive crank arm 67, with the legs 75 extending down along opposite sides of the drive crank 67, and with the rail feet 76 being respectively disposed in the track channels 25 for sliding movement therealong. The thickness of the rail feet 76 is substantially equal to the depth of the track channels 25 so that the rail feet 76 can fit between the track channels 25 and the bottom plate 31 of the top base 30.

In operation, when the kicker assembly 20 is at rest, it is disposed in the position illustrated in FIG. 3, with the contacts of the switch 45 open, with the solenoid plunger rod 55 being held in its fully extended position by the compression spring 56, with the drive crank arm 67 extending generally vertically and with the kicker member 70 disposed at the rear end of the aperture 42 in the tilt plate 40, the tilt plate 40 being maintained in a substantially horizontal position a slight distance above the upper edge of the cylindrical wall 33 by the compression springs 44, so that the bottom surface of the tilt plate 40 is substantially coplanar with the upper surface 11 of the playfield board 10. When a pin ball 15 rolls into a kicking region forwardly of the kicker member 70, it rolls up the bevelled edge 41 of the tilt plate 40, tilting it downwardly into engagement with the upper edge of the cylindrical wall 33 (see FIG. 6), thereby tilting the lower ends of the actuator posts 43 rearwardly for closing the switch contacts 46. It will be appreciated that the terminals of the solenoid coil 51 are connected through the switch 45 to a suitable source of electric power. Thus, upon closure of the contacts 46, the solenoid coil 51 will be energized, thereby to retract the plunger rod 55 against the urging of the compression spring 56 and move the kicker assembly 20 to the position illustrated in solid line in FIG. 7.

Figure 7:
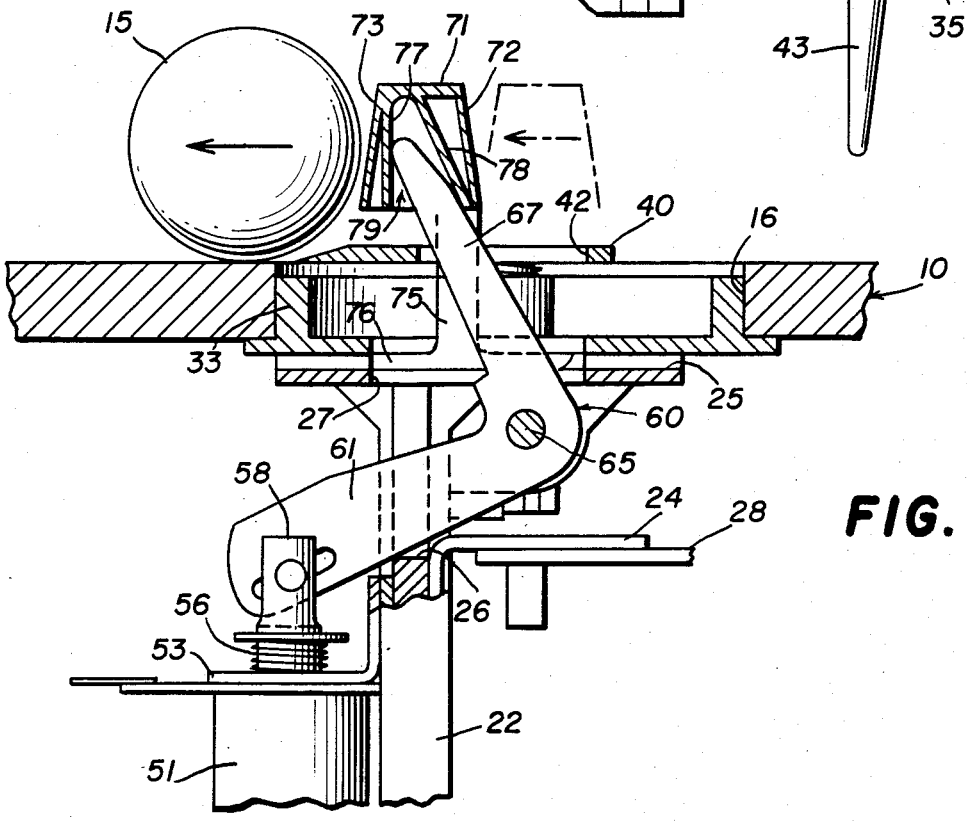
FIG. 7 is a fragmentary view in vertical section taken generally along line 7—7 in FIG. 5.

In particular, the downward vertical movement of the plunger rod 55 will pivot the drive crank 60 in a counterclockwise direction, as viewed in FIG. 7, about the axis of the pivot pin 65, thereby to move the upper end of the drive crank arm 67 downwardly and forwardly in a well known manner. The drive crank arm 67 is disposed in sliding engagement with the inner surface of the bearing wall 77 so that the pivotal movement of the drive crank arm 67 operates to slide the kicker member 70 horizontally forwardly along the path defined by the track channels 25, parallel to the playfield board 10, in the direction of the broken-line arrow in FIG. 7. In this manner, the kicking surface 73 is moved horizontally into engagement with the pin ball 15 for imparting to it an accelerating force directed substantially parallel to the playfield board 10, as indicated by the solid line arrow in FIG. 7.

Because of the wide face of the kicking surface 73, which extends substantially across the entire diameter of the tilt plate 40, the kicker member 70 will engage the pin ball 15 regardless of its position on the arcuate portion of the tilt plate 40. Thus, the kicker assembly 20 will be actuated and will kick the pin ball 15 in the predetermined kicking direction regardless of the direction from which the pin ball engages the arcuate portion of the tilt plate 40. It will be appreciated that the angle of inclination of the plane of the kicking surface 73 can be varied to impart slight overspin or underspin to the pinball 15. Normally the kicking surface 73 will be disposed to avoid overspin on the pin ball 15 so as to minimize wear on the playfield board.

While, in the preferred embodiment, the kicker assembly 20 has been illustrated as being of the type designed for direct impact with the pin ball 15, it will be appreciated that a similar type of wide-face kicker member could also be used with a sling-slot type bumper assembly of the kind illustrated in my aforementioned copending application Ser. No. 338,314. In such an application of the kicker assembly 20, the broad kicking surface 73 would impact the elastic rebound band of the bumper assembly uniformly over an extended length thereof, thereby to maximize the region of maximum kicking deflection of the elastic band.

While the kicker member 70 may be formed of any suitable material, it is preferably of one-piece unitary construction, being molded of a suitable plastic material such as nylon. The frame 21, the top base 30, the tilt plate 40 and the drive crank 60 may also be formed of plastic material.

It will also be appreciated that instead of the tilt plate 40, other types of actuators could be used for the solenoid switch 45 such as, for example, the actuator arms disclosed in copending application Ser. No. 353,878, filed Mar. 2, 1982 or the bimetallic actuator disclosed in copending application Ser. No. 409,414, filed Aug. 19, 1982.

From the foregoing, it can be seen that there has been provided an improved kicker assembly for a pin ball game, which provides a wide-face kicking surface suitable for direct impact with the pin ball.

What is claimed is:

1. A pin ball game kicker apparatus for propelling a pin ball with a predetermined diameter into rolling engagement with a playfield board, said kicker apparatus comprising a frame, track means on said frame defining a rectilinear path, a kicker member cooperating with said track means for reciprocating movement with respect thereto along said path between a normal rest position and a kicking position, said kicker member having a kicking surface with a dimension in a direction transverse to said path and parallel to the playfield board greater than the predetermined diameter of an associated pin ball, said kicking surface being disposed above the playfield board for engagement with an associated pin ball when said kicker member is moved to its kicking position, and drive means carried by said frame and coupled to said kicker member for effecting movement thereof between the rest and kicking positions thereof.

2. The kicker apparatus of claim 1, wherein said kicker member includes guide means disposed for sliding engagement with said track means for sliding movement along said path.

3. The kicker apparatus of claim 1, wherein said kicker member is of unitary one-piece construction.

4. The kicker apparatus of claim 1, wherein said kicking surface is a substantially flat, planar surface.

5. The kicker apparatus of claim 4, wherein the plane of said kicking surface is inclined at an acute angle with respect to said path.

6. The kicker apparatus of claim 1, wherein said drive means includes a drive member mounted on said frame for pivotal movement about an axis substantially perpendicular to said path and parallel to said kicking surface, said drive member being engageable with said kicking member for effecting movement thereof.

7. The kicker apparatus of claim 6, wherein said kicker member includes a receptacle means for receiving therein one end of the associated drive member for engagement therewith.

* * * * *